US009398387B2

(12) United States Patent
Shibuya et al.

(10) Patent No.: US 9,398,387 B2
(45) Date of Patent: Jul. 19, 2016

(54) SOUND PROCESSING DEVICE, SOUND PROCESSING METHOD, AND PROGRAM

(71) Applicant: Sony Corporation, Tokyo (JP)

(72) Inventors: Takashi Shibuya, Tokyo (JP); Mototsugu Abe, Kanagawa (JP); Masayuki Nishiguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 276 days.

(21) Appl. No.: 14/075,015

(22) Filed: Nov. 8, 2013

(65) Prior Publication Data

US 2014/0140519 A1 May 22, 2014

(30) Foreign Application Priority Data

Nov. 16, 2012 (JP) ..... 2012-251809
Feb. 27, 2013 (JP) ..... 2013-037542

(51) Int. Cl.
*H04R 29/00* (2006.01)
*H04R 3/04* (2006.01)

(52) U.S. Cl.
CPC . *H04R 29/00* (2013.01); *H04R 3/04* (2013.01)

(58) Field of Classification Search
CPC ..... G10L 15/20; G10L 15/08; G10L 25/48; G10L 17/04; G10L 17/20; G10L 17/22; G10L 17/24; G10L 17/26; G10L 19/008; G10L 2021/02165; G10L 2021/02166; G10L 13/00; G10L 13/06; G10L 13/10; H04N 21/44218; H04N 5/232; H04N 19/48; H04N 19/87; H04N 5/147; H04N 7/15; H04N 19/139; H04N 19/159; H04N 19/44; H04N 19/61; H04N 1/00183; H04N 1/00403; H04N 21/23424; H04R 29/00; H04R 2225/41; H04R 2430/00; H04R 2430/03; H04R 2460/01; H04R 2460/07; H04R 2499/13; H04R 25/02; H04R 25/50; H04R 25/505; H04R 25/554; H04R 25/558; H04R 29/001
USPC ..... 381/56–58; 704/236, 200.1, 230; 700/94; 84/659, 600–602
See application file for complete search history.

(56) References Cited

U.S. PATENT DOCUMENTS 8,754,315 B2 * 6/2014 Shibuya ..... G06F 17/30743 700/94
2012/0266743 A1 * 10/2012 Shibuya ..... G06F 17/30743 84/659

FOREIGN PATENT DOCUMENTS

JP 2009-276776 * 11/2009 ..... H04W 4/06
JP 2009-276776 A 11/2009
JP 2012-098360 A 5/2012
JP 2012-226080 A 11/2012

OTHER PUBLICATIONS

Shibuy A et al., Fast Background Retrieval using Tonal Structure Descriptor. Technical Report of Information Processing Society of Japan. SIG-MUS: Music and Computer. Japan. Jul. 29, 2011; 2011-MUS-91(17):4026-8.

* cited by examiner

*Primary Examiner* — Lun-See Lao

(57) ABSTRACT

There is provided a sound processing device including an input signal processing unit configured to calculate a first acoustic feature quantity indicating a likelihood being of a sinusoidal wave of a signal in each time frequency domain and a second acoustic feature quantity different from the first acoustic feature quantity based on an input signal of content to be identified, a reference signal processing unit configured to calculate the first acoustic feature quantity and the second acoustic feature quantity based on a reference signal of content prepared in advance, and a matching processing unit configured to calculate a similarity between the input signal and the reference signal based on the first and second acoustic feature quantities of the input signal and the first and second acoustic feature quantities of the reference signal.

7 Claims, 10 Drawing Sheets

SOUND PROCESSING DEVICE, SOUND PROCESSING METHOD, AND PROGRAM

CROSS REFERENCE TO RELATED APPLICATIONS

This application claims the benefit of Japanese Priority Patent Application JP 2013-037542 filed Feb. 27, 2013, the entire contents of which are incorporated herein by reference.

BACKGROUND

The present technology relates to a sound processing device, a sound processing method, and a program. More particularly, the present technology relates to a sound processing device, sound processing method, and program, capable of identifying any content with higher accuracy.

As an example, a sound signal constituting content is set as a reference signal, and an input signal is obtained by picking up sound reproduced based on the reference signal in any device. When match retrieval is performed based on these input signal and reference signal, content can be identified. In this case, sound outputted from an original sound source is picked up in a state where reverberation or noise is mixed therein, and thus sound based on the input signal becomes the sound where a reverberation sound or noise is superimposed on sound of content.

As an example of such a content identification technique, there has been a musical piece identification technique in which a signal of a noiseless music recorded in a CD (Compact Disc) or the like is set as a reference signal and its background music is identified from an input signal with which non-musical sound is mixed.

In the musical piece identification technique, identification of a musical piece is performed by a process of matching between an acoustic feature quantity extracted from the reference signal of a noiseless music and an acoustic feature quantity extracted from the input signal. In the following description, it is assumed that the input signal is mixed with a noise, and thus an acoustic feature quantity obtained from the input signal would be affected by the noise.

Thus, for example, a mask pattern is used in the matching process. The mask pattern is information representing a reliable element from among elements constituting an acoustic feature quantity. In the matching process using the mask pattern, matching is performed by dividing each element constituting a multi-dimensional acoustic feature quantity into a reliable element and an unreliable element and by using only a reliable element based on the mask pattern.

As a musical piece identification technique using a mask pattern in this way, there is proposed, for example, an approach of performing a musical piece identification in which a plurality of mask patterns are prepared in advance to mask a given time frequency domain with respect to a feature matrix having a time frequency component (for example, refer to Japanese Unexamined Patent Application Publication No. 2009-276776).

In the above-described approach, the musical piece identification is performed by setting a maximum value among the similarities calculated by using all mask patterns previously prepared with respect to a feature matrix of an input signal and a feature matrix of a musical piece in a database, that is, the feature matrix of a reference signal as the similarity between an input signal and a musical piece. In this musical piece identification, a plurality of fixed mask patterns which are in dependent on the input signal are stored and the matching process is performed using these mask patterns.

SUMMARY

However, in the techniques described above, the identification of content is specialized in the match retrieval of music, and thus it may be impossible to identify any commonly used content, for example, content such as a broadcasting program. As an example, for the broadcasting program content, there may be a case where a sound signal of a scene with no music is necessary to retrieve as an input signal. However, in such a case, it is difficult to identify content using the above-described technique.

Furthermore, in the above-described technique, the influence of reverberation in sound is not considered and thus it may be impossible to realize the content identification with high accuracy. In other words, the input signal is affected by reverberation in actual use environment and the reverberation adversely affects the retrieval. Therefore, in an environment with strong reverberation, the accuracy of a match retrieval of content is reduced.

Moreover, in the technique disclosed in Japanese Unexamined Patent Application Publication No. 2009-276776, a fixed mask pattern is used. However, for a mixed noise included in the input signal, it may be impossible to predict when the noise is included and what kind of properties the noise has. Thus, it is difficult to prepare an optimal mask pattern to the input signal in advance. As a result, it may be impossible to identify content using a mask pattern prepared in advance with high accuracy.

An embodiment of the present technology has been made in view of such a situation. It is desirable to identify any content with higher accuracy.

According to an embodiment of the present technology, there is provided a sound processing device including an input signal processing unit configured to calculate a first acoustic feature quantity indicating a likelihood being of a sinusoidal wave of a signal in each time frequency domain and a second acoustic feature quantity different from the first acoustic feature quantity based on an input signal of content to be identified, a reference signal processing unit configured to calculate the first acoustic feature quantity and the second acoustic feature quantity based on a reference signal of content prepared in advance, and a matching processing unit configured to calculate a similarity between the input signal and the reference signal based on the first and second acoustic feature quantities of the input signal and the first and second acoustic feature quantities of the reference signal.

The matching processing unit may generate a mask pattern indicating a likelihood being of a signal of content in each time frequency domain based on the first acoustic feature quantity of the input signal and the first acoustic feature quantity of the reference signal, and calculate the similarity based on the mask pattern, the first acoustic feature quantity, and the second acoustic feature quantity.

The matching processing unit may further calculate a similarity between the first acoustic feature quantity of the input signal and the first acoustic feature quantity of the reference signal, and calculate the similarity between the input signal and the reference signal based on the mask pattern, the similarity between the first acoustic feature quantities, and the second acoustic feature quantity.

The matching processing unit may calculate the similarity between the first acoustic feature quantities by making a contribution ratio of the reference signal to the similarity between the first acoustic feature quantities larger than a contribution ratio of the input signal to the similarity between the first acoustic feature quantities.

The second acoustic feature quantity may be calculated based on a spectrogram of the input signal or the reference signal and have a same granularity in a time axis and a frequency axis as the first acoustic feature quantity.

According to an embodiment of the present technology, there is provided a sound processing method and a program including calculating a first acoustic feature quantity indicating a likelihood being of a sinusoidal wave of a signal in each time frequency domain and a second acoustic feature quantity different from the first acoustic feature quantity based on an input signal of content to be identified, calculating the first acoustic feature quantity and the second acoustic feature quantity based on a reference signal of content prepared in advance, and calculating a similarity between the input signal and the reference signal based on the first and second acoustic feature quantities of the input signal and the first and second acoustic feature quantities of the reference signal.

According to an embodiment of the present technology, a first acoustic feature quantity indicating a likelihood being of a sinusoidal wave of a signal in each time frequency domain and a second acoustic feature quantity different from the first acoustic feature quantity are calculated based on an input signal of content to be identified, and the first acoustic feature quantity and the second acoustic feature quantity are calculated based on a reference signal of content prepared in advance, and a similarity between the input signal and the reference signal is calculated based on the first and second acoustic feature quantities of the input signal and the first and second acoustic feature quantities of the reference signal.

According to one or more of embodiments of the present disclosure, it is possible to identify any content with higher accuracy.

DETAILED DESCRIPTION OF THE EMBODIMENT(S)

Figure 1:
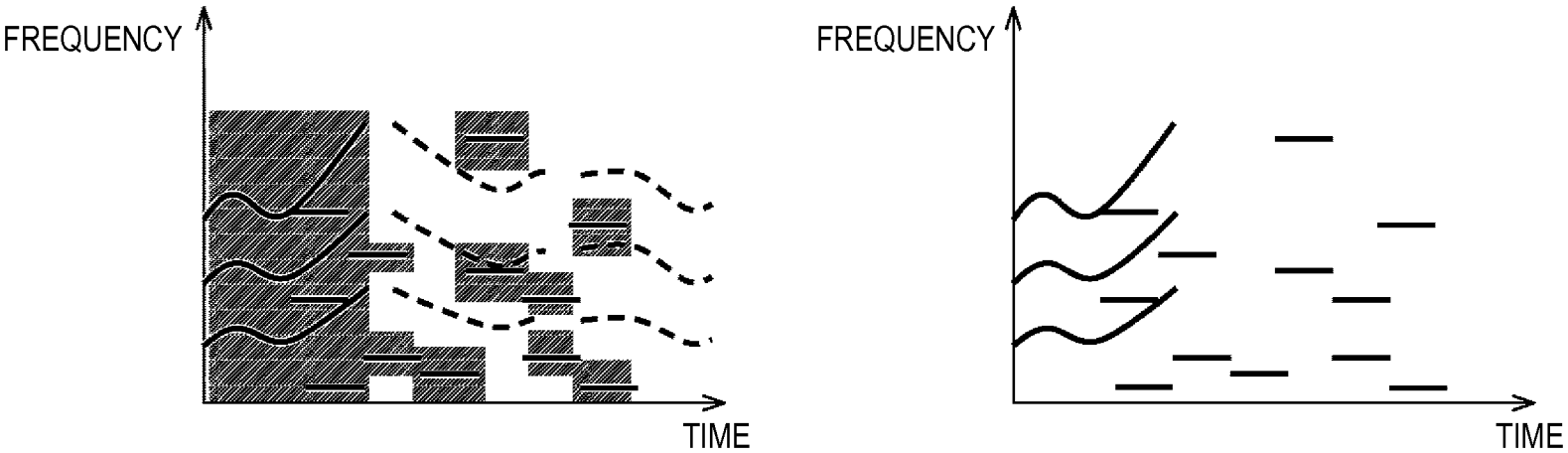
FIG. 1 is a diagram for explaining a mask pattern.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

<First Embodiment>

<Technical Features of an Embodiment of the Present Technology>

An embodiment of the present technology makes it possible, by using a recording function of a portable terminal device such as a multi-functional mobile phone or tablet-type terminal device, to identify any content such as a television program, radio program, and streaming distribution content which the user is viewing with another device.

In a case where sound to be processed is outputted from a loudspeaker of a device such as television receivers, radio sets, or personal computers, and the outputted sound is recorded by a portable terminal device, the sound passes through the space between the loudspeaker of the device and the portable terminal device. Thus, the sound obtained by the recording would also include reverberation of the sound due to traveling in the space. In addition, the sound obtained by the recording is mixed with sound other than the sound outputted from the loudspeaker of the device (hereinafter, this is referred to as a "mixed noise").

In an embodiment of the present technology, it is desirable to perform the match retrieval of content, which is robust to the reverberation or mixed noise. More generally, it is desirable to perform the match retrieval between an original sound source (dry source) and a sound source superimposed with the reverberation or mixed noise produced by passing a given sound source through a space.

Technical features of an embodiment of the present technology will now be described. For example, an embodiment of the present technology may have five technical features as follows.

Technical Features (1)

A mask pattern is generated using an index indicating the likelihood of being a sinusoidal wave in each of clipped time frequency domains, which is calculated for an input signal and a reference signal.

Technical Features (2)

The index indicating the likelihood of being a sinusoidal wave is quantified by the stability of the spectral shape in a minute time.

Technical Features (3)

The likelihood of being sinusoidal wave is an index which is robust to reverberation.

Technical Features (4)

A mask pattern is generated using information of an input signal as well as information of a reference signal.

Technical Features (5)

When similarity between an input signal and a reference signal is calculated, the similarity is calculated by giving priority to the reference signal rather than to the input signal, instead of treating them as equivalent.

As an example, in an embodiment of the present technology, a spectrogram of an input signal and a spectrogram of a reference signal are obtained as shown in FIG. 1. In addition, in FIG. 1, the vertical axis indicates frequency and the horizontal axis indicates time.

In FIG. 1, the right side of the figure indicates the spectrogram of a reference signal, and the left side of the figure indicates the spectrogram of an input signal.

In the spectrogram, i.e., the time frequency domain of an input signal, a component represented by the solid line indicates a sound component which is also included in the reference signal, and components represented by the dotted line indicates a component of mixed noise which is not included in the reference signal.

In an embodiment of the present technology, a reliable time frequency domain that is a region of the hatched portion in the figure is specified by generating a mask pattern, and a matching process between the input signal and the reference signal is performed by only using this reliable time frequency domain.

According to the embodiments of the present technology, advantageous effects can be obtained as follows.

Advantageous Effects (1)

By using a scene with no music as well as a scene with music, it is possible to identify the content.

Advantageous Effects (2)

Even in the space with reverberation, it is possible to identify content such as a viewing program.

Advantageous Effects (3)

Even when sound (a mixed noise) other than the sound included in an original reference signal is included in the input signal, it is possible to identify content such as a viewing program.

<Exemplary Configuration of Sound Processing Device>

A specific embodiment to which the present technology is applied will now be described.

Figure 2:
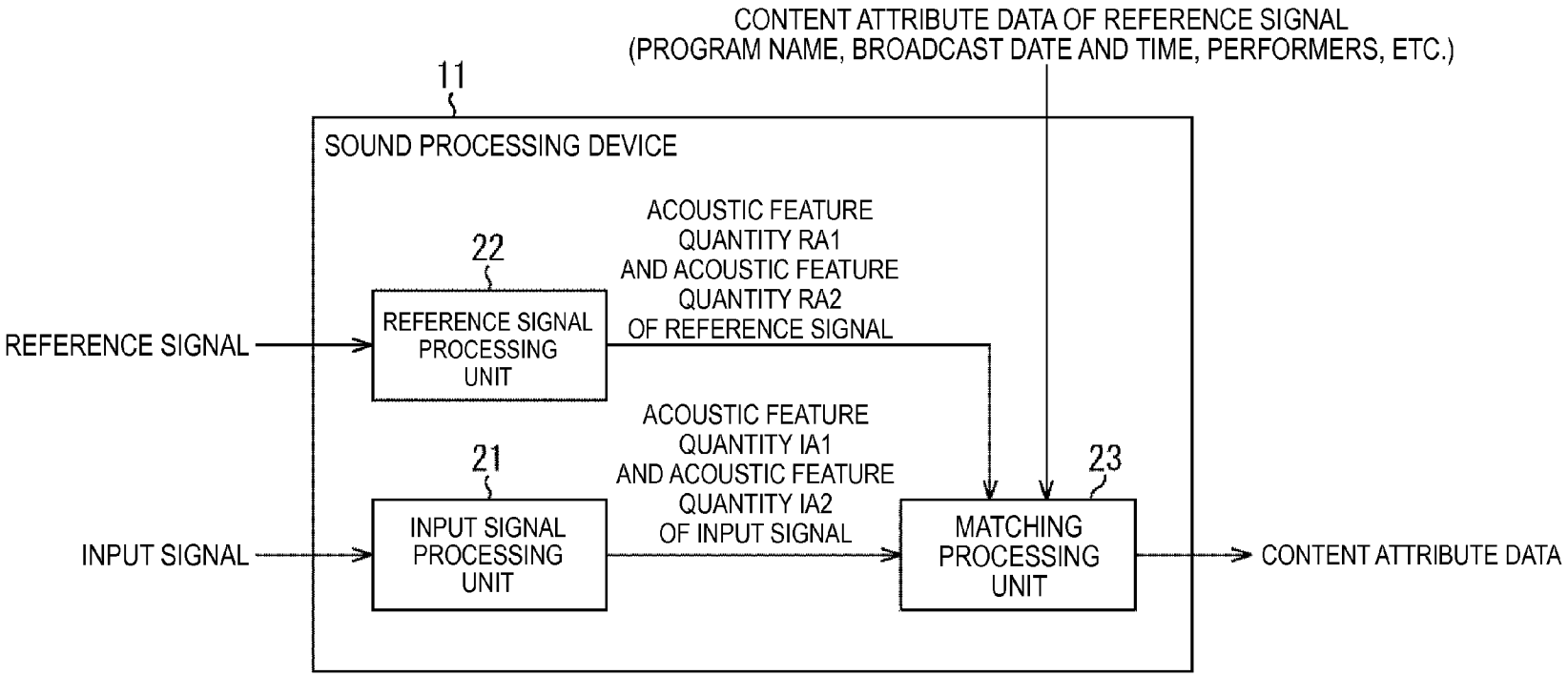
FIG. 2 is a diagram illustrating an exemplary configuration of a sound processing device.

FIG. 2 is a diagram illustrating an exemplary configuration of a sound processing device according to an embodiment of the present technology.

The sound processing device 11 is configured to include an input signal processing unit 21, a reference signal processing unit 22, and a matching processing unit 23.

A reference signal of sound included in content that has been prepared in advance and an input signal of sound included in content to be identified are inputted to the sound processing device 11. The input signal is obtained by recording (picking up) the sound based on the reference signal reproduced from a given device in another device. For example, the input signal may be a sound signal obtained by the recording in the sound processing device 11.

Furthermore, for example, a sound signal of a plurality of content items is inputted as a reference signal. In addition, content attribute data of the reference signal is also inputted to the sound processing device 11. The content attribute data is content-related data including a content name (program name), broadcast date and time, performers, and so on.

The input signal processing unit 21 analyzes the supplied input signal to generate two types of acoustic feature quantity IA1 and acoustic feature quantity IA2, and then supplies them to the matching processing unit 23.

The reference signal processing unit 22 analyzes the supplied reference signal that is an original sound source of content to generate two types of acoustic feature quantity RA1 and acoustic feature quantity RA2, and then supplies them to the matching processing unit 23. The acoustic feature quantity RA1 and acoustic feature quantity RA2 are corresponded to the acoustic feature quantity IA1 and acoustic feature quantity IA2, respectively.

The acoustic feature quantity IA1 and the acoustic feature quantity IA2 have the same feature quantity (the same type of feature quality), and the acoustic feature quantity RA1 and the acoustic feature quantity RA2 have the same feature quantity. In the following, the acoustic feature quantity IA1 and the acoustic feature quantity IA2 will be simply referred to as the acoustic feature quantity A1, if there is unnecessary to make a distinction between them. In addition, the acoustic feature quantity RA1 and acoustic feature quantity RA2 will be simply referred to as the acoustic feature quantity A2, if there is unnecessary to make a distinction between them.

The matching processing unit 23 performs a matching process between the input signal and the reference signal to identify the content, based on the acoustic feature quantity IA1 and acoustic feature quantity IA2 supplied from the input signal processing unit 21 and the acoustic feature quantity RA1 and acoustic feature quantity RA2 supplied from the reference signal processing unit 22. In addition, the matching processing unit 23 outputs content attribute data of the content identified by the matching process among from the supplied content attribute data and also outputs the result obtained by the matching process.

<Exemplary Configuration of Input Signal Processing Unit>

Figure 3:
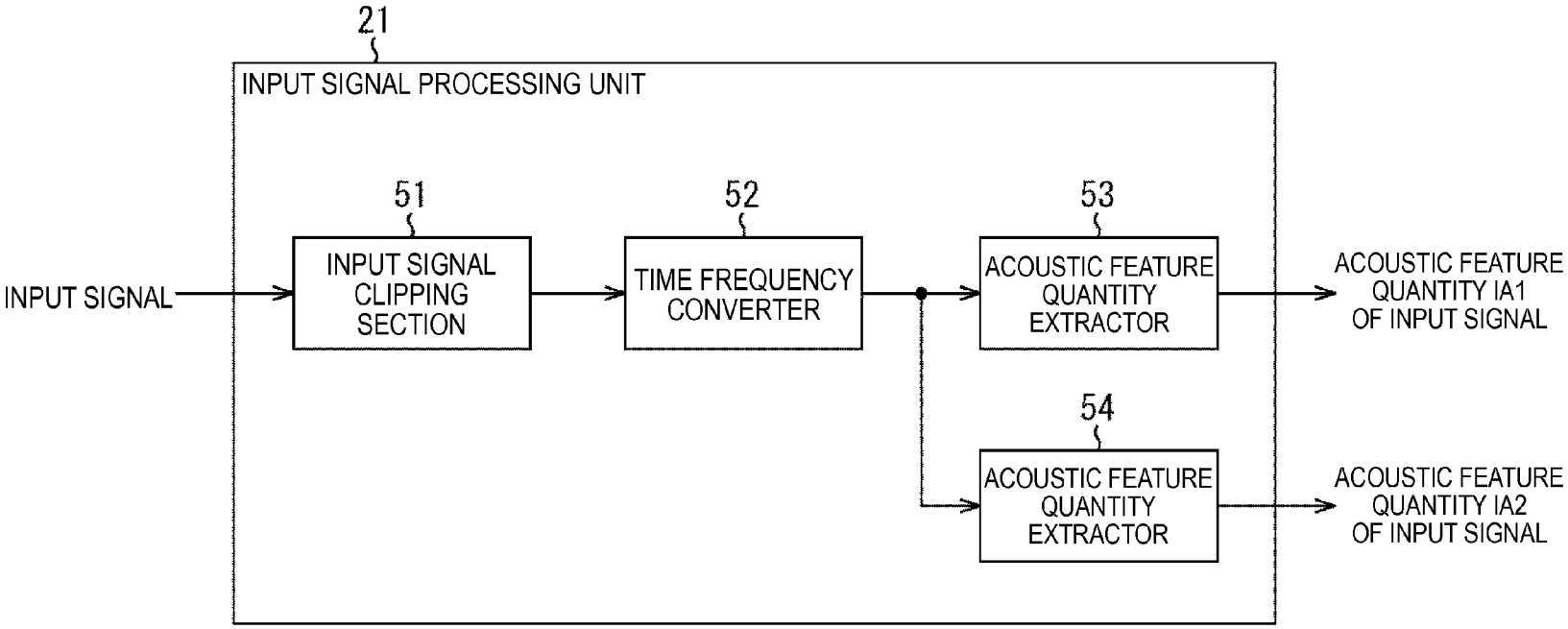
FIG. 3 is a diagram illustrating an exemplary configuration of an input signal processing unit.

The input signal processing unit 21 shown in FIG. 2 is more specifically configured as shown in FIG. 3. The input signal processing unit 21 shown in FIG. 3 is configured to include an input signal clipping section 51, a time frequency converter 52, an acoustic feature quantity extractor 53, and an acoustic feature quantity extractor 54.

The input signal clipping section 51 clips a section having a predetermined length of time from the supplied input signal, and supplies the clipped input signal to the time frequency converter 52. The time frequency converter 52 performs time frequency conversion on the input signal supplied from the input signal clipping section 51 to convert the input signal into a log-magnitude spectrogram, and outputs the spectrogram to the acoustic feature quantity extractors 53 and 54.

The acoustic feature quantity extractor 53 calculates an acoustic feature quantity IA1 based on the log-magnitude spectrogram supplied from the time frequency converter 52 and supplies the calculated acoustic feature quantity IA1 to the matching processing unit 23. The acoustic feature quantity extractor 54 calculates an acoustic feature quantity IA2 based on the log-magnitude spectrogram supplied from the time frequency converter 52 and supplies the calculated acoustic feature quantity IA2 to the matching processing unit 23.

The acoustic feature quantities IA1 and IA2 will now be described.

As an example, the acoustic feature quantity IA1 and the acoustic feature quantity IA2 are all represented by a matrix with two axes corresponding to the time component and the frequency component, respectively. Each matrix has the following features.

In other words, the acoustic feature quantity IA1 is a feature matrix which represents the likelihood of being a sinusoidal wave of the input signal in each time frequency domain Moreover, the acoustic feature quantity IA2 is a feature quantity used for matching between the input signal, and the reference signal and is a feature matrix which represents individuality of the signal. However, the granularity of the time axis and frequency axis of the acoustic feature quantity IA2 is the same as that of the time axis and frequency axis of the acoustic feature quantity IA1.

Furthermore, a process where the input signal processing unit 21 calculates the acoustic feature quantity IA1 and the acoustic feature quantity IA2 will now be described in detail.

The input signal clipping section 51 clips a signal having a certain length of time (for example, five seconds) from the input signal which are continuously inputted and outputs the clipped signal to the time frequency converter 52. The time frequency converter 52 converts the clipped input signal into a log-magnitude spectrogram (hereinafter, simply referred to as a spectrogram).

Furthermore, the acoustic feature quantity extractor 53 converts the spectrogram into an intermediate feature quantity obtained by digitizing the likelihood of being a sinusoidal wave of the spectrogram in the divided time frequency domains.

In other words, the stability in a minute time of the spectrogram is used to digitize the likelihood of being a sinusoidal wave. Musical instrument sound or human voice can be regarded as a sinusoidal wave in which frequency is substantially constant in a minute time (for example, 0.020 seconds) unlike noise, and thus the spectrogram is substantially constant in shape.

The acoustic feature quantity extractor 53 digitizes the stability of the spectrogram in a minute time for each frequency band by using this property and regards the digitized value as an index indicating the likelihood being of a sinusoidal wave. More specifically, the acoustic feature quantity extractor 53 performs a peak detection process for each time frame of the spectrogram, and approximates the log-magnitude spectrogram to the bi-quadratic function g(k,n) represented by the following Equation (1) for the time frequency domain around the peak.

$$g(k,n)=\bar{a}k^2+\bar{b}k+\bar{c} \quad (1)$$

In Equation (1), k represents a frequency bin number of the spectrogram, and n represents a time frame number of the spectrogram. In addition, the approximation of the log-magnitude spectrogram is performed using an optimization technique such as a least-squares method.

Next, the acoustic feature quantity extractor 53 approximates the log-magnitude spectrum of each time frame of the time frequency domain around the detected peak to the quadratic function $f_n(k)$ represented by the following Equation (2).

$$f_n(k)=a_nk^2+b_nk+c_n \quad (2)$$

Similarly, the approximation is performed using an optimization technique such as a least-squares method.

Furthermore, the acoustic feature quantity extractor 53 calculates the likelihood being of a sinusoidal wave by the following Equation (3) using a coefficient obtained by the approximation to the two types of functions of the bi-quadratic function g(k,n) and the quadratic function $f_n(k)$.

$$\eta(n,k)=1-\alpha\sqrt{\Sigma\{D_1(a_n,\bar{a})+D_2(b_n,\bar{b})\}} \quad (3)$$

In Equation (3), α is a parameter with a positive value. D(x,y), that is, $D_1(x,y)$ and $D_2(x,y)$ represent a distance function.

Moreover, when time frequency conversion is performed on the sinusoidal wave, there is the theoretical value a of the second-order coefficient of the quadratic function. The likelihood being of a sinusoidal wave may be calculated by the following Equation (4) in consideration of the proximity of the theoretical value and the calculated second-order coefficient.

$$\eta(n,k)=1-\alpha\sqrt{\Sigma\{D_1(a_n,\bar{a})+D_2(b_n,\bar{b})+D_3(a_n,\bar{a})\}} \quad (4)$$

In Equation (4), η(n,k) means the likelihood being of a sinusoidal wave at each peak, and thus if η(n,k)<0, η(n,k) becomes 0. With this, η(n,k) takes a value ranging from 0 to 1.

Further, η(n,k)=0 for a frequency bin that does not correspond to the peak, and a vector containing information of the likelihood being of sinusoidal wave of each frequency bin is obtained for the corresponding time frame. The likelihood being of a sinusoidal wave is a feature quantity which is robust to the reverberation, and thus eventually a retrieval which is robust to the reverberation can be performed.

The vector obtained in the manner described above is calculated while shifting the time frame, and the obtained vector is arranged in time series and subjected to down-sampling in the time axis direction, thereby obtaining the acoustic feature quantity IA1. To perform down-sampling, a smoothing filter (low pass filter) is used. A value obtained by the filtering means a time average value of the likelihood being of a sinusoidal wave at each frequency.

For each element of the obtained acoustic feature quantity IA1, a quantization process or a non-linear process such as logarithmic function, exponential function, or sigmoid function may be performed.

Furthermore, in the acoustic feature quantity extractor 54, the spectrogram is converted into the acoustic feature quantity IA2.

As an example, a first-order differential filter is applied to the matrix of the likelihood being of a sinusoidal wave calculated in a similar way to the acoustic feature quantity IA1 in the time axis direction, and the matrix obtained in this way is subjected to down-sampling, thereby obtaining the acoustic feature quantity IA2. A value obtained by the filtering of a first-order differential filter means the time variation of the likelihood being of a sinusoidal wave at each frequency.

For each element of the obtained acoustic feature quantity IA2, a quantization process or a non-linear process such as logarithmic function, exponential function, or sigmoid function may be performed. Furthermore, as the acoustic feature quantity IA2, a value representing individuality of the signal may be used, for example, a value obtained by normalizing the time average a spectrum in a certain time interval may be used.

<Exemplary Configuration of Reference Signal Processing Unit>

Figure 4:
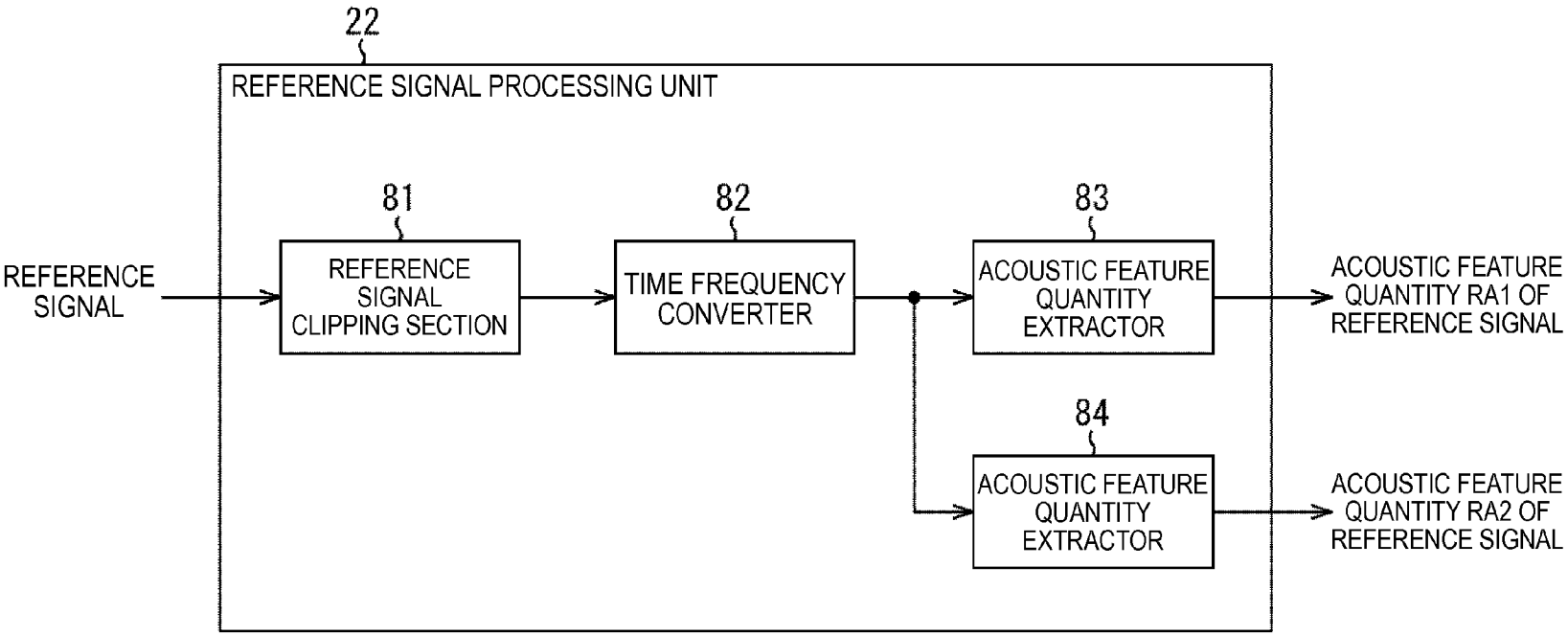
FIG. 4 is a diagram illustrating an exemplary configuration of a reference signal processing unit.

FIG. 4 illustrates a more detailed configuration of the reference signal processing unit 22 shown in FIG. 2. The reference signal processing unit 22 shown in FIG. 4 is configured to include a reference signal clipping section 81, a time frequency converter 82, an acoustic feature quantity extractor 83, and an acoustic feature quantity extractor 84.

The reference signal clipping section 81 clips a section having a predetermined length of time from the supplied reference signal and supplies the clipped input signal to the time frequency converter 82. The time frequency converter 82 performs the time frequency conversion on the reference signal supplied from the reference signal clipping section 81 to convert the reference signal into a log-magnitude spectrogram, and outputs the spectrogram to the acoustic feature quantity extractor 83 and the acoustic feature quantity extractor 84.

The acoustic feature quantity extractor 83 calculates an acoustic feature quantity RA1 based on the log-magnitude spectrogram supplied from the time frequency converter 82 and supplies the calculated acoustic feature quantity RA1 to the matching processing unit 23. The acoustic feature quantity extractor 84 calculates an acoustic feature quantity RA2 based on the log-magnitude spectrogram supplied from the time frequency converter 82 and supplies the calculated acoustic feature quantity RA2 to the matching processing unit 23.

The acoustic feature quantity extractor 83 and the acoustic feature quantity extractor 84 correspond to the acoustic feature quantity extractor 53 and the acoustic feature quantity extractor 54, respectively. The acoustic feature quantity extractor 83 and the acoustic feature quantity extractor 84 output the acoustic feature quantity RA1 and the acoustic feature quantity RA2, respectively. The acoustic feature quantity RA1 and the acoustic feature quantity RA2 have the same granularity in a time axis and a frequency axis as the acoustic feature quantity IA1 and the acoustic feature quantity IA2, respectively.

In addition, the acoustic feature quantity RA1 and the acoustic feature quantity RA2 which are extracted from the reference signal may be directly supplied to the matching processing unit 23, or may be supplied to a storage device for being saved as a database. However, when the acoustic feature quantity RA1 and the acoustic feature quantity RA2 are supplied to a storage device, it is necessary for the acoustic feature quantity RA1 and the acoustic feature quantity RA2 to be saved in combination with metadata (program name, broadcast data and time, performers, etc.) of the reference signal, that is, content attribute data.

<Exemplary Configuration of Matching Processing Unit>

Figure 5:
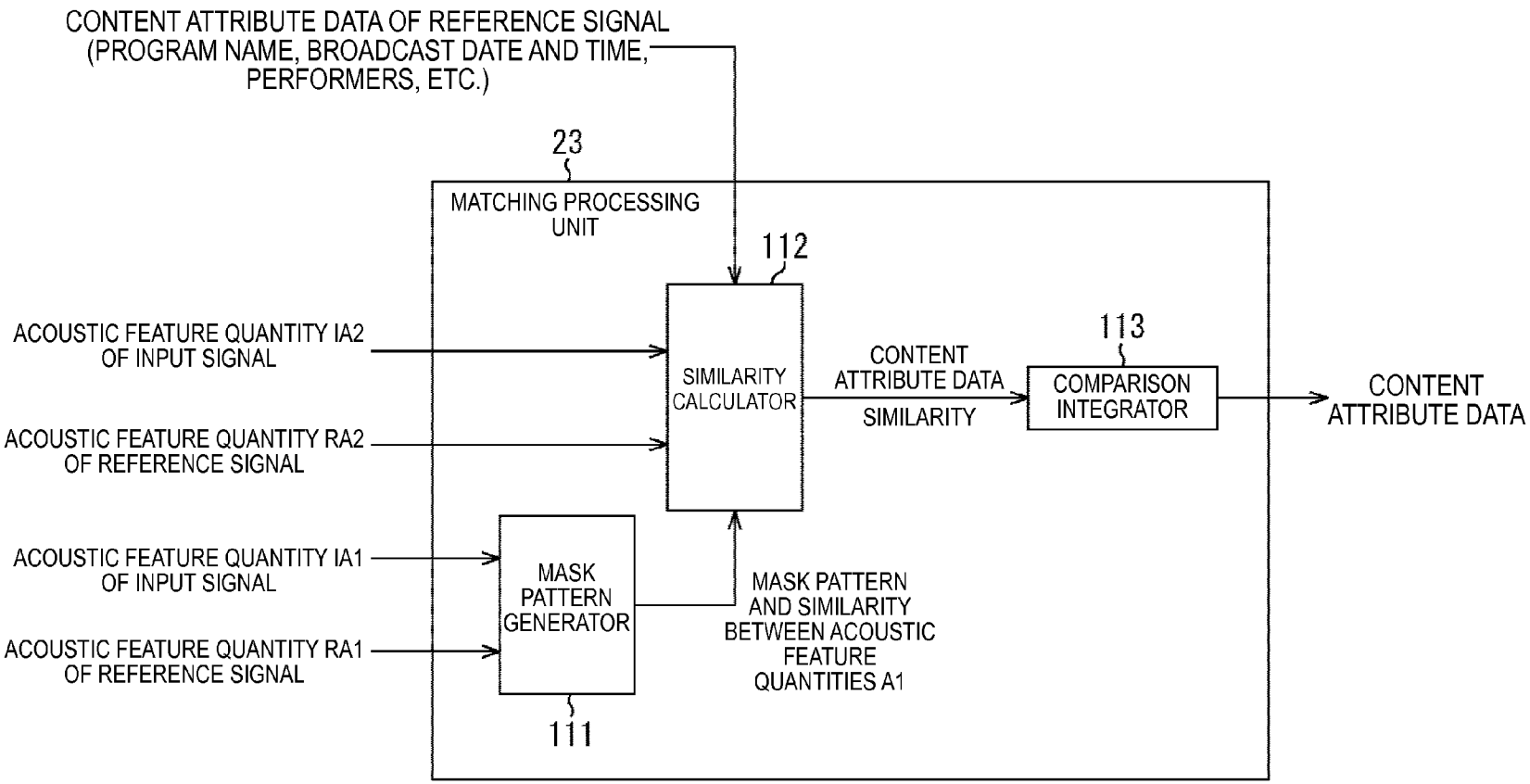
FIG. 5 is a diagram illustrating an exemplary configuration of a matching processing unit.

FIG. 5 illustrates a more detailed configuration of the matching processing unit 23 shown in FIG. 2. The matching processing unit 23 shown in FIG. 5 is configured to include a mask pattern generator 111, a similarity calculator 112, and a comparison integrator 113.

The mask pattern generator 111 generates a mask pattern based on the acoustic feature quantity IA1 supplied from the acoustic feature quantity extractor 53 and the acoustic feature quantity RA1 supplied from the acoustic feature quantity extractor 83. The mask pattern generator 111 then outputs the generated mask pattern and a similarity between the acoustic feature quantities A1 to the similarity calculator 112. The mask pattern indicates the reliability of the likelihood being of a signal of content in each time frequency domain, that is, a reliable time frequency domain.

The similarity calculator 112 calculates a similarity of the input signal to the reference signal, based on the acoustic feature quantity IA2 supplied from the acoustic feature quantity extractor 54, the acoustic feature quantity RA2 supplied from the acoustic feature quantity extractor 84, and the mask pattern and similarity supplied from the mask pattern generator 111. In addition, the similarity calculator 112 supplies the calculated similarity and the supplied content attribute data to the comparison integrator 113.

The comparison integrator 113 determines whether content of the reference signal and content included in the input signal are identical to each other based on the similarity supplied from the similarity calculator 112, and outputs the determination result and content attribute data.

The matching processing unit 23 calculates the similarity between the reference signal and the input signal. For example, as shown in FIG. 6, when a fragmented piece of the reference signal is included in the input signal having a certain period of time (for example, five seconds), a matrix of the acoustic feature quantity IA1 and the acoustic feature quantity IA2 of the input signal is generally smaller in the number of components in the time direction than the acoustic feature quantity RA1 and the acoustic feature quantity RA2 of the reference signal.

Thus, the similarity is calculated by clipping a partial matrix having the same length as the length of the acoustic feature quantity IA1 and the acoustic feature quantity IA2 of the input signal in the time direction from a matrix of the acoustic feature quantity RA1 and the acoustic feature quantity RA2 of the reference signal. For the clipping of the partial matrix, all of the partial matrices that can be cut out are clipped. The clipping process is performed in the mask pattern generator 111 and the similarity calculator 112.

Figure 6:
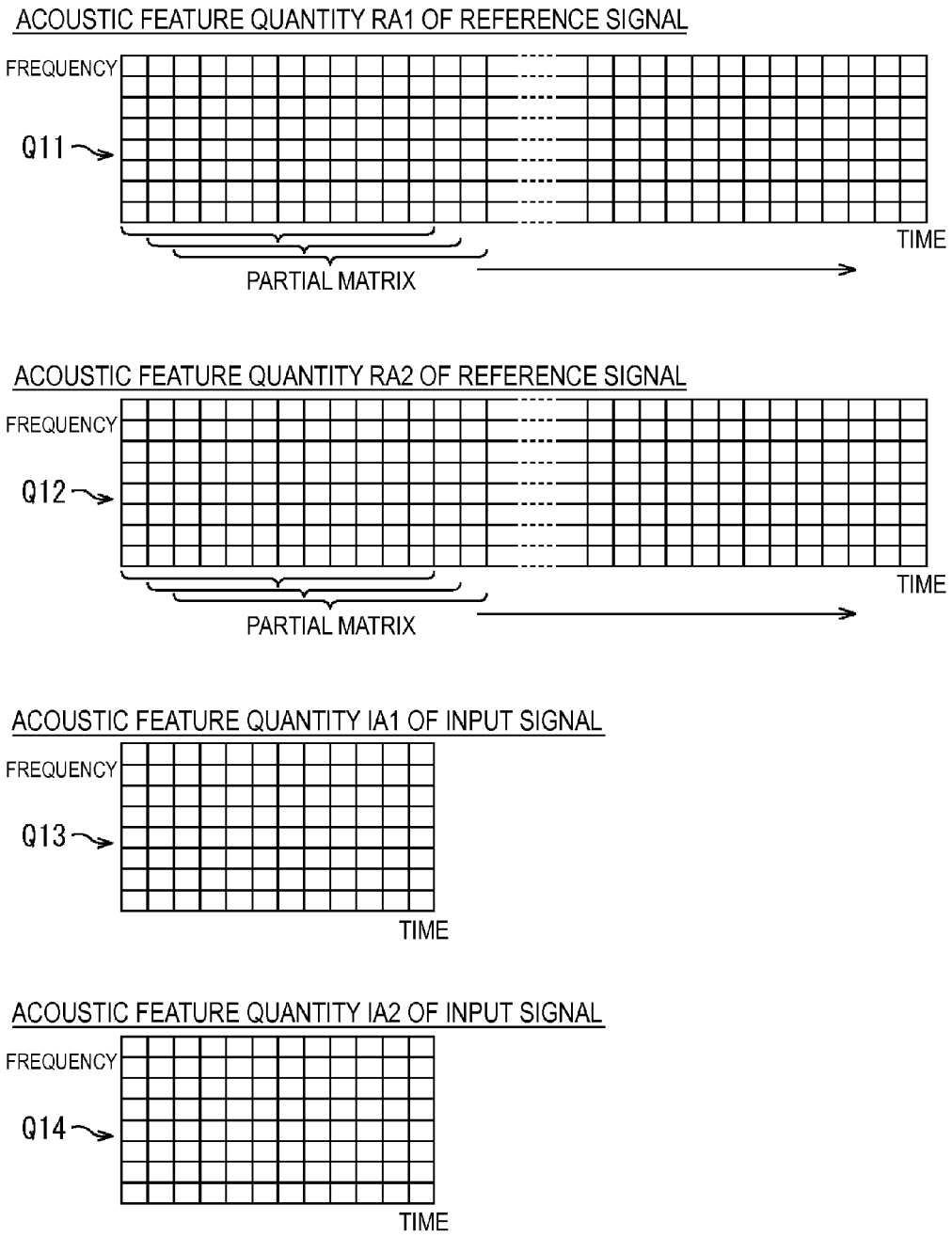
FIG. 6 is a diagram for explaining an acoustic feature quantity.

In FIG. 6, the vertical direction represents frequency and the horizontal direction represents time. In addition, the rectangular shapes indicated by arrows Q11, Q12, Q13, and Q14 represent the acoustic feature quantity RA1 of the reference signal, the acoustic feature quantity RA2 of the reference signal, the acoustic feature quantity IA1 of the input signal, and the acoustic feature quantity IA2 of the input signal, respectively.

In this example, it can be seen that the acoustic feature quantity RA1 and the acoustic feature quantity RA2 extracted from the reference signal are longer in the horizontal direction, that is, the time direction in the figure and are greater in the number of components in the time direction than the acoustic feature quantity IA1 and the acoustic feature quantity IA2 extracted from the input signal.

Thus, a portion of the acoustic feature quantity RA1 and the acoustic feature quantity RA2 is clipped into a partial matrix. This partial matrix is used to calculate the similarity.

Next, a detailed process to be performed in the matching processing unit 23 will now be described.

The mask pattern generator 111 generates a mask pattern from the acoustic feature quantity IA1 of the input signal and the acoustic feature quantity RA1 of the reference signal, and further calculates the similarity between the acoustic feature quantities A1. The mask pattern is represented as a two-dimensional matrix with the time and frequency axes in a similar way to the acoustic feature quantities A1.

For example, a matrix that masks the time frequency domain where there is no sinusoidal wave is generated as a mask pattern from the acoustic feature quantity IA1 of the input signal and the acoustic feature quantity RA1 of the reference signal. More specifically, for example, the mask pattern is generated by calculating the following Equation (5).

$$W_{f(t+u)}=S_{fu}^{(1)}A_{f(t+u)}^{(1)} \tag{5}$$

In Equation (5), $W_{f(t+u)}$ represents a matrix element of the mask pattern, $S^{(1)}_{fu}$ represents a matrix element of the acoustic feature quantity IA1 of the input signal, and $A^{(1)}_{f(t+u)}$ represents an element of the partial matrix of the acoustic feature quantity RA1 of the reference signal.

In addition, f represents a frequency component of each matrix, u represents a time component of each matrix, and t represents a time offset of the partial matrix.

The mask pattern calculated in this way is used as the weight for each time frequency domain in the similarity calculator 112 of the subsequent stage. In other words, there is calculated the similarity which gives priority to the time frequency domain having a large value of the matrix element $W_{f(t+u)}$ of the mask pattern.

The similarity between the acoustic feature quantities A1 is a non-negative index obtained by quantifying the proximity of two feature quantities, and is calculated, for example, by the following Equation (6).

$$R^{(1)}(t)=\frac{\sum S_{fu}^{(1)}A_{f(t+u)}^{(1)}}{\left(\sum S_{fu}^{(1)p}\right)^{1/p}\cdot\left(\sum A_{f(t+u)}^{(1)q}\right)^{1/q}} \tag{6}$$

In Equation (6), $R^{(1)}(t)$ represents the similarity between $S^{(1)}_{fu}$ and $A^{(1)}_{f(t+u)}$. In addition, p and q are parameters for adjusting a contribution ratio to the similarity between the acoustic feature quantity IA1 of the input signal and the acoustic feature quantity RA1 of the reference signal. In other words, p and q are weighting coefficients having a value of 1 or more satisfying $1/p+1/q=1$.

For example, by making p larger than q, the similarity which gives priority to sound included in the reference signal is calculated, and even when a mixed noise unrelated to the reference signal is included in the input signal, it is possible to perform the matching in which its effect is reduced. Further, as the similarity between the acoustic feature quantities, in addition to the similarity described above, a value to be calculated based on the difference in two matrices such as square error or absolute error may be used.

Furthermore, the similarity calculator 112 calculates a final similarity by using the acoustic feature quantity IA2 of the input signal, the acoustic feature quantity RA2 of the reference signal, the mask pattern, and the similarity between the acoustic feature quantities A1.

A similarity to be calculated by the similarity calculator 112 is obtained by regarding the mask pattern having information of the likelihood being of a sinusoidal wave in the time frequency domain as the reliability in each time frequency domain, and by weighting and quantifying the obtained mask pattern. In addition, the similarity to be calculated by the similarity calculator 112 is an index of the proximity between the acoustic feature quantity IA2 of the input signal and the acoustic feature quantity RA2 of the reference signal in the time frequency domain. Further, in consideration of the similarity between the acoustic feature quantities A1, for example, the similarity R(t) is calculated by the computation of the following Equation (7).

$$R(t) = \frac{\sum W_{f(t+u)} \exp\left(-\beta\left(S^{(2)}_{fu} - A^{(2)}_{f(t+u)}\right)^2\right)}{\sum W_{f(t+u)}} R^{(1)}(t) \tag{7}$$

In Equation (7), $A^{(2)}_{f(t+u)}$ represents a partial matrix of the acoustic feature quantity RA2 of the reference signal, and $S^{(2)}_{fu}$ represents a matrix of the acoustic feature quantity IA2 of the input signal. In addition, β is a parameter with a positive value.

Moreover, a value to be calculated based on the difference in two matrices (the acoustic feature quantity IA2 of the input signal and the acoustic feature quantity RA2 of the reference signal) such as square error or absolute error may be used to calculate the similarity, in addition to the calculation by Equation (7).

The comparison integrator 113 determines whether content of the reference signal and content included in the input signal are identical to each other based on the similarity calculated by the similarity calculator 112.

A method of determining as to whether the contents are identical to each other is a method of determining to be content in which the reference signal having the largest similarity that exceeds a predetermined threshold is included in the input signal from among similarities obtained for a plurality of reference signals. In addition, if any similarity of the reference signals does not exceed the threshold value, it is determined that there is no target content in the reference signals.

Furthermore, the threshold to be used here may be a fixed value typically or may be set statistically from a plurality of similarities obtained from the input signal and the plurality of reference signals.

<Description of Match Retrieval Process>

In a case where the input signal and the reference signal are supplied to the sound processing device 11, if there is an instruction of content identification, the sound processing device 11 performs a match retrieval process and then performs the content identification. Referring to the flowchart of FIG. 7, the match retrieval process by the sound processing device 11 will now be described.

In step S11, the input signal clipping section 51 clips the supplied input signal and supplies the clipped input signal to the time frequency converter 52. For example, the input signal having a certain length of time is clipped.

In step S12, the time frequency converter 52 performs the time frequency conversion on the input signal supplied from the input signal clipping section 51 to convert the input single into a log-magnitude spectrogram, and then supplies the log-magnitude spectrogram to the acoustic feature quantity extractor 53 and the acoustic feature quantity extractor 54.

In step S13, the acoustic feature quantity extractor 53 performs the extraction process of the acoustic feature quantity IA1 to calculate the acoustic feature quantity IA1 of the input signal, and then supplies the calculated acoustic feature quantity IA1 to the mask pattern generator 111 of the matching processing unit 23.

Figure 8:
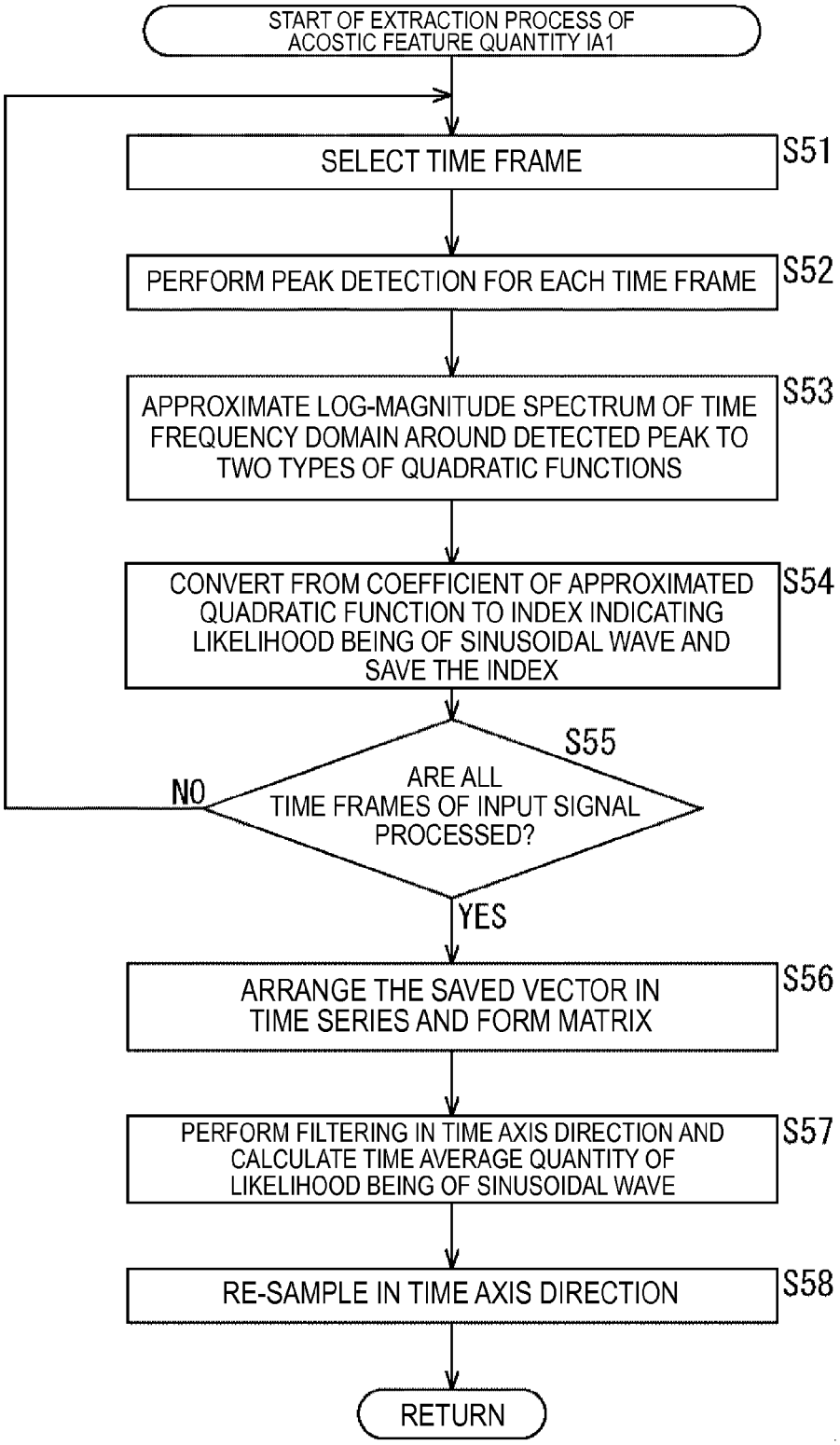
FIG. 8 is a flowchart for explaining an extraction process of an acoustic feature quantity IA1.

In the following, referring to the flowchart of FIG. 8, the extraction process of the acoustic feature quantity IA1 to be performed by the acoustic feature quantity extractor 53 will be described. This extraction process corresponds to the process of step S13.

In step S51, the acoustic feature quantity extractor 53 selects a time frame for the log-magnitude spectrogram supplied from the time frequency converter 52.

In step S52, the acoustic feature quantity extractor 53 performs peak detection for the selected time frame of the log-magnitude spectrogram.

In step S53, the acoustic feature quantity extractor 53 approximates the log-magnitude spectrum of the time frequency domain around the detected peak to two types of quadratic functions. For example, the log-magnitude spectrogram is approximated to the functions shown in Equation (1) and Equation (2).

In step S54, the acoustic feature quantity extractor 53 converts from a coefficient of the approximated quadratic function into an index indicating the likelihood being of a sinusoidal wave and saves the index. For example, η(n,k) of Equation (3) is calculated as the index indicating the likelihood being of a sinusoidal wave.

In step S55, the acoustic feature quantity extractor 53 determines whether all time frames of the input signal are processed. If it is determined that all time frames of the input signal are not yet processed in step S55, the process returns to step S51, and the above-described process is repeated.

On the other hand, in step S55, if it is determined that all time frames of the input signal are processed, then, in step S56, the acoustic feature quantity extractor 53 forms a matrix by arranging the saved vector of the index of the likelihood being of a sinusoidal wave in time series.

In step S57, the acoustic feature quantity extractor 53 performs the filtering on the index indicating the likelihood being of a sinusoidal wave formed as a matrix, that is, the matrix of the likelihood being of a sinusoidal wave in the time axis direction, and then calculates a time average quantity of the likelihood being of a sinusoidal wave. For example, the filtering is performed using a smoothing filter.

In step S58, the acoustic feature quantity extractor 53 performs re-sampling on the time average quantity of the likelihood being of a sinusoidal wave obtained by the filtering in the time axis direction, and regards the re-sampled result as the acoustic feature quantity IA1. When the acoustic feature quantity extractor 53 supplies the acoustic feature quantity IA1 extracted from the input signal in this way to the mask pattern generator 111, the extraction process of the acoustic feature quantity IA1 is terminated. After that, the process proceeds to step S14 of FIG. 7.

In step S14, the acoustic feature quantity extractor 54 calculates an acoustic feature quantity IA2 of the input signal by performing an extraction process and then supplies the calculated acoustic feature quantity IA2 to the similarity calculator 112 of the matching processing unit 23.

Figure 9:
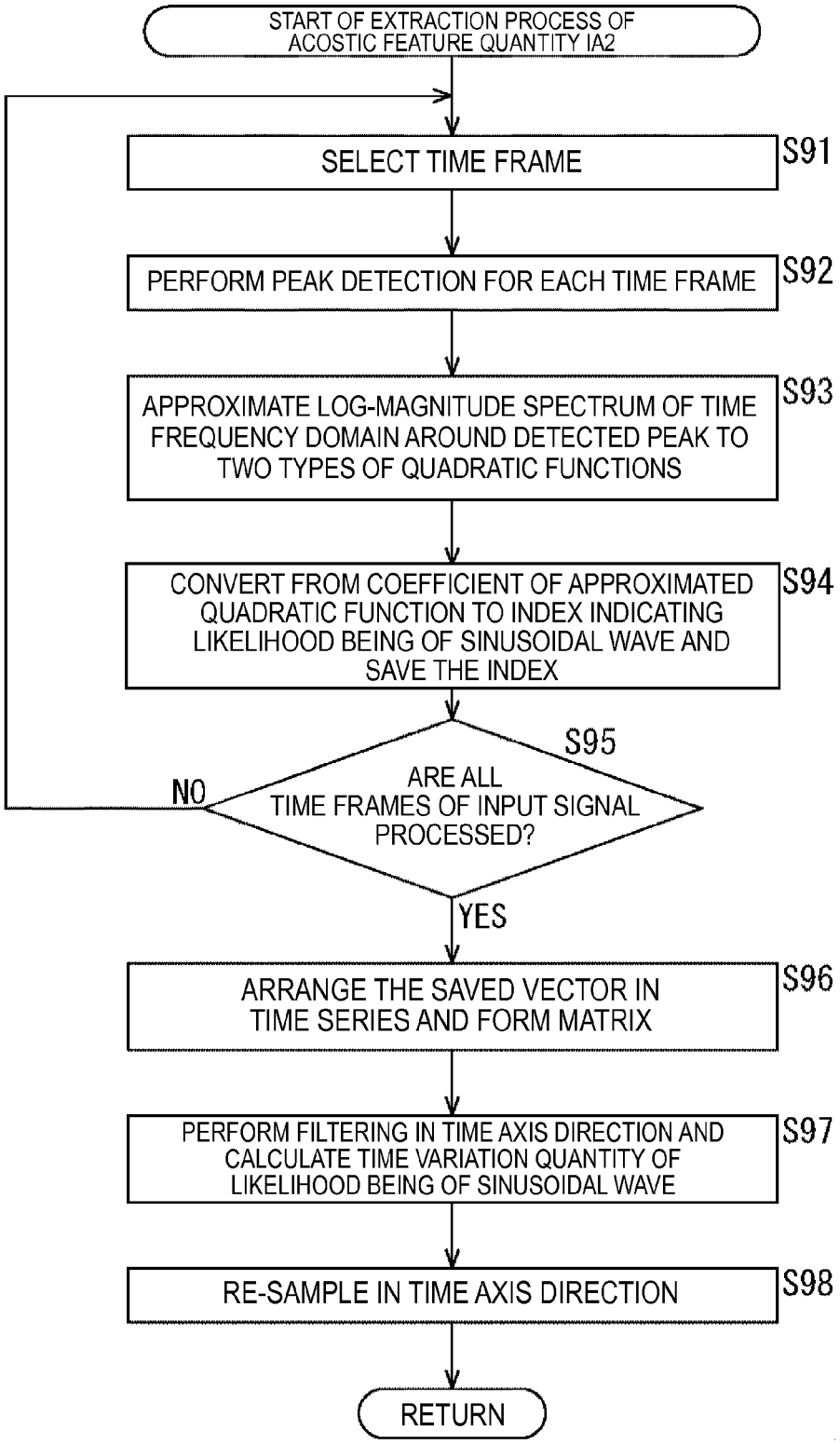
FIG. 9 is a flowchart for explaining an extraction process of an acoustic feature quantity IA2.

In the following, referring to the flowchart of FIG. 9, the extraction process of the acoustic feature quantity IA2 to be performed by the acoustic feature quantity extractor 54 will be described. This extraction process corresponds to the process of step S14. In addition, processes of steps S91 to S96 are similar to those of steps S51 to S56 in FIG. 8, and thus a description thereof is omitted.

After performing the process of step S96, the matrix of the likelihood being of a sinusoidal wave is obtained. In step S97, the acoustic feature quantity extractor 54 performs the filtering on the matrix of the likelihood being of a sinusoidal wave in the time direction and calculates time variation quantity of the likelihood being of a sinusoidal wave. The filtering is performed, for example, by a first-order differential filter.

In step S98, the acoustic feature quantity extractor 54 performs re-sampling on the time average variation quantity of the likelihood being of a sinusoidal wave obtained by the filtering in the time axis direction, and regards the re-sampled result as the acoustic feature quantity IA2. When the acoustic feature quantity extractor 54 supplies the acoustic feature quantity IA2 extracted from the input signal in this way to the similarity calculator 112, the extraction process of the acoustic feature quantity IA2 is terminated. After that, the process proceeds to step S15 of FIG. 7.

Figure 7:
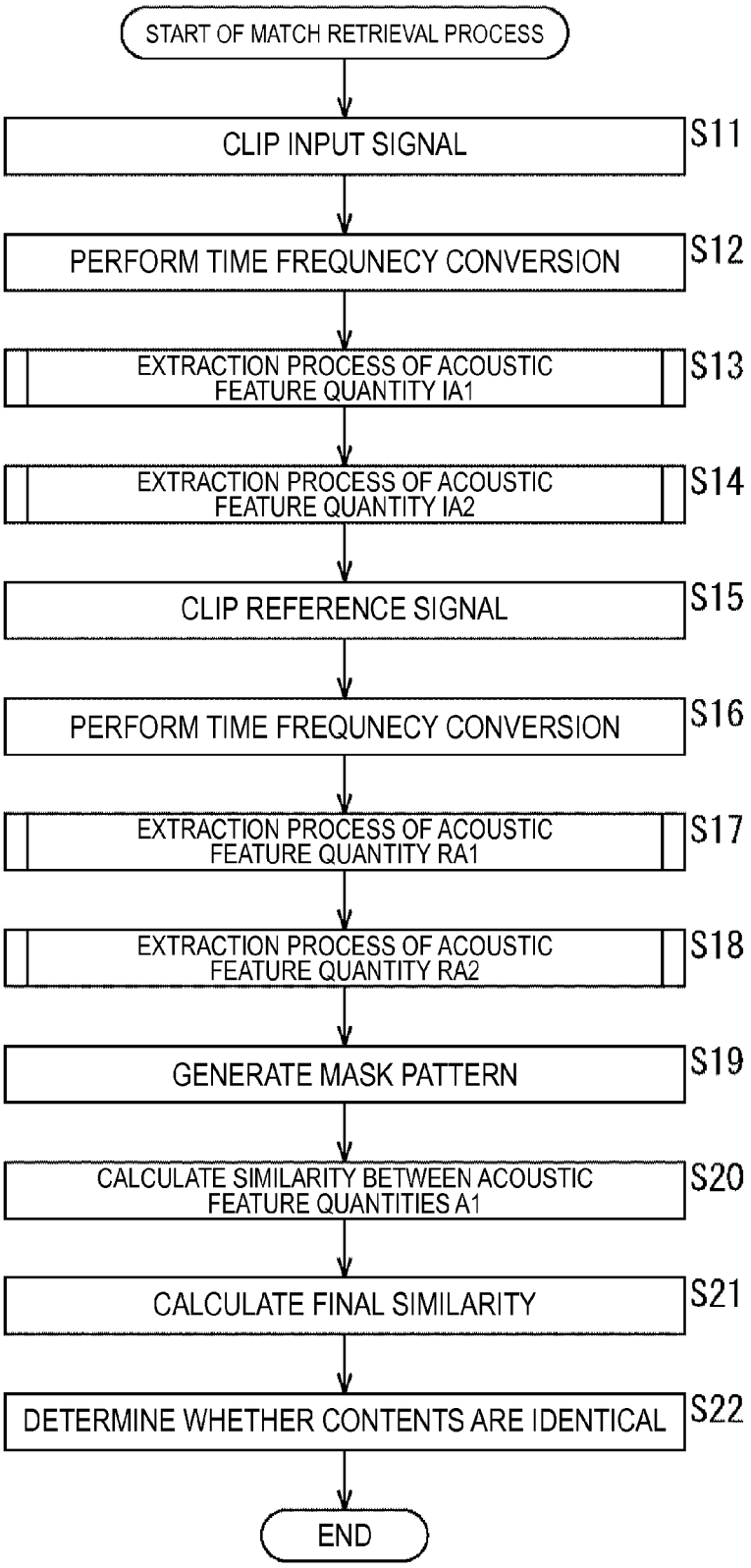
FIG. 7 is a flowchart for explaining a match retrieval process.

Referring back to the flowchart of FIG. 7, in step S15, the reference signal clipping section 81 clips the supplied reference signal and supplies the clipped signal to the time frequency converter 82.

In step S16, the time frequency converter 82 performs the time frequency conversion on the reference signal supplied from the reference signal clipping section 81, converts the reference signal into a log-magnitude spectrogram, and supplies the log-magnitude spectrogram to the acoustic feature quantity extractor 83 and the acoustic feature quantity extractor 84.

In step S17, the acoustic feature quantity extractor 83 performs the extraction process of the acoustic feature quantity RA1 to calculate the acoustic feature quantity RA1 of the reference signal and then supplies the calculated acoustic feature quantity RA1 to the mask pattern generator 111 of the matching processing unit 23.

In addition, in step S18, the acoustic feature quantity extractor 84 performs the extraction process of an acoustic feature quantity RA2 to calculate the acoustic feature quantity RA2 of the reference and then supplies the calculated acoustic feature quantity RA2 to the similarity calculator 112 of the matching processing unit 23.

Furthermore, the processes of steps S17 and S18 are similar to those of steps S13 and S14, and thus a description thereof is omitted. However, in the processes of steps S17 and S18, a signal to be processed is the reference signal rather than the input signal.

In step S19, the mask pattern generator 111 generates a mask pattern based on the acoustic feature quantity IA1 supplied from the acoustic feature quantity extractor 53 and the acoustic feature quantity RA1 supplied from the acoustic feature quantity extractor 83. For example, the mask pattern generator 111 generates a mask pattern by performing the calculation of Equation (5).

In step S20, the mask pattern generator 111 calculates a similarity between the acoustic feature quantities A1. For example, mask pattern generator 111 calculates a similarity between the acoustic feature quantities A1 by using Equation (6). The mask pattern generator 111 supplies the generated mask pattern and the similarity between the acoustic feature quantities A1 to the similarity calculator 112.

In step S21, the similarity calculator 112 calculates a final similarity between the input signal and the reference signal based on the acoustic feature quantity IA2 supplied from the acoustic feature quantity extractor 54, the acoustic feature quantity RA2 supplied from the acoustic feature quantity extractor 84, and the mask pattern and similarity supplied from the mask pattern generator 111.

For example, the similarity calculator 112 calculates a similarity between the input signal and the reference signal, that is, between content of the input signal and content of the reference signal by performing the calculation of Equation (7), and supplies the calculated similarity and content attribute data to the comparison integrator 113.

In step S22, the comparison integrator 113 determines whether content of the reference signal and content included in the input signal are identical to each other based on the similarity supplied from the similarity calculator 112.

For example, the comparison integrator 113 specifies the largest similarity that exceeds a predetermined threshold from among similarities obtained for a plurality of reference signals, and regards content of the reference single of the specified similarity as content of the input signal. The comparison integrator 113 outputs content attribute data of content of the input signal specified in this way and results obtained by the determination of content identification, and then the match retrieval is terminated.

As described above, the sound processing device 11 calculates an acoustic feature quantity A1 indicating the likelihood being of a sinusoidal wave from the input single and the reference signal, and generates a mask pattern from the acoustic feature quantity A1. The sound processing device 11 calculates a similarity based on the mask pattern and the acoustic feature quantity A2 indicating individuality of the signal.

Thus, when a mask pattern is generated based on the acoustic feature quantity IA1 obtained from the input signal and the acoustic feature quantity RA1 obtained from the reference signal, it is possible to obtain a mask pattern which is robust to the reverberation or mixed noise. As a result, it is possible to identify content with higher accuracy.

The series of processes described above can be executed by hardware but can also be executed by software. When the series of processes is executed by software, a program that constructs such software is installed into a computer. Here, the expression "computer" includes a computer in which dedicated hardware is incorporated and a general-purpose personal computer or the like that is capable of executing various functions when various programs are installed.

Figure 10:
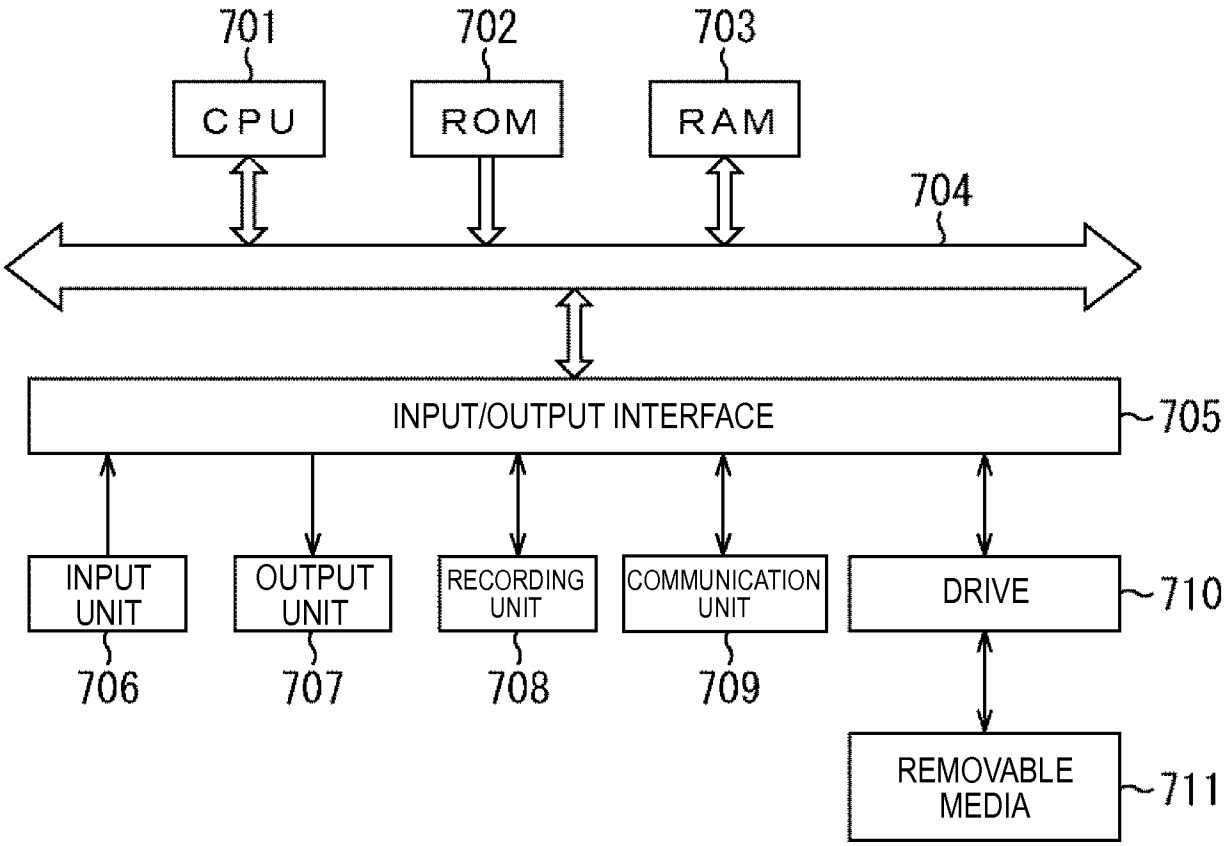
FIG. 10 is a diagram illustrating an exemplary configuration of a computer.

FIG. 10 is a block diagram showing an example configuration of the hardware of a computer that executes the series of processes described earlier according to a program.

In the computer, a central processing unit (CPU) 701, a read only memory (ROM) 702, and a random access memory (RAM) 703 are mutually connected by a bus 704.

An input/output interface 705 is also connected to the bus 704. An input unit 706, an output unit 707, a recording unit 708, a communication unit 709, and a drive 710 are connected to the input/output interface 705.

The input unit 706 is configured from a keyboard, a mouse, a microphone, an imaging device, or the like. The output unit 707 configured from a display, a speaker, or the like. The recording unit 708 is configured from a hard disk, a non-volatile memory or the like. The communication unit 709 is configured from a network interface or the like. The drive 710 drives a removable media 711 such as a magnetic disk, an optical disk, a magneto-optical disk, a semiconductor memory or the like.

In the computer configured as described above, the CPU 701 loads a program that is stored, for example, in the recording unit 708 onto the RAM 703 via the input/output interface 705 and the bus 704, and executes the program. Thus, the above-described series of processing is performed.

Programs to be executed by the computer (the CPU 701) are provided being recorded in the removable media 711 which is a packaged media or the like. Also, programs may be provided via a wired or wireless transmission medium, such as a local area network, the Internet or digital satellite broadcasting.

In the computer, by inserting the removable media 711 into the drive 710, the program can be installed in the recording unit 708 via the input/output interface 705. Further, the program can be received by the communication unit 709 via a wired or wireless transmission media and installed in the recording unit 708. Moreover, the program can be installed in advance in the ROM 702 or the recording unit 708.

It should be noted that the program executed by a computer may be a program that is processed in time series according to the sequence described in this specification or a program that is processed in parallel or at necessary timing such as upon calling.

It should be understood by those skilled in the art that various modifications, combinations, sub-combinations and alterations may occur depending on design requirements and other factors insofar as they are within the scope of the appended claims or the equivalents thereof.

For example, the present disclosure can adopt a configuration of cloud computing which processes by allocating and connecting one function by a plurality of apparatuses through a network.

Further, each step described in the above-mentioned flow charts can be executed by one apparatus or by allocating a plurality of apparatuses.

In addition, in the case where a plurality of processes are included in a single step, the plurality of processes included in this one step can be executed by one apparatus or by sharing among a plurality of apparatuses.

Additionally, the present technology may also be configured as below.

(1) A sound processing device including:

an input signal processing unit configured to calculate a first acoustic feature quantity indicating a likelihood being of a sinusoidal wave of a signal in each time frequency domain and a second acoustic feature quantity different from the first acoustic feature quantity based on an input signal of content to be identified;

a reference signal processing unit configured to calculate the first acoustic feature quantity and the second acoustic feature quantity based on a reference signal of content prepared in advance; and a matching processing unit configured to calculate a similarity between the input signal and the reference signal based on the first and second acoustic feature quantities of the input signal and the first and second acoustic feature quantities of the reference signal.

(2) The sound processing device according to (1), wherein the matching processing unit generates a mask pattern indicating a likelihood being of a signal of content in each time frequency domain based on the first acoustic feature quantity of the input signal and the first acoustic feature quantity of the reference signal, and calculates the similarity based on the mask pattern, the first acoustic feature quantity, and the second acoustic feature quantity.

(3) The sound processing device according to (2), wherein the matching processing unit further calculates a similarity between the first acoustic feature quantity of the input signal and the first acoustic feature quantity of the reference signal, and calculates the similarity between the input signal and the reference signal based on the mask pattern, the similarity between the first acoustic feature quantities, and the second acoustic feature quantity.

(4) The sound processing device according to (3), wherein the matching processing unit calculates the similarity between the first acoustic feature quantities by making a contribution ratio of the reference signal to the similarity between the first acoustic feature quantities larger than a contribution ratio of the input signal to the similarity between the first acoustic feature quantities.

(5) The sound processing device according to any one of (1) to (4), wherein the second acoustic feature quantity is calculated based on a spectrogram of the input signal or the reference signal and has a same granularity in a time axis and a frequency axis as the first acoustic feature quantity.

What is claimed is:

1. A sound processing device comprising:

processing circuitry that functions as:

an input signal processing unit configured to calculate a first acoustic feature quantity indicating a likelihood of being a sinusoidal wave of a signal in each time frequency domain and a second acoustic feature quantity different from the first acoustic feature quantity based on an input signal of content to be identified;

a reference signal processing unit configured to calculate the first acoustic feature quantity and the second acoustic feature quantity based on a reference signal of content prepared in advance; and a matching processing unit configured to calculate a similarity between the input signal and the reference signal based on the first and second acoustic feature quantities of the input signal and the first and second acoustic feature quantities of the reference signal and to output content attribute data of the content to be identified based on the similarity.

2. The sound processing device according to claim 1, wherein the matching processing unit is configured to generate a mask pattern indicating a likelihood of being a signal of the content to be identified in each time frequency domain based on the first acoustic feature quantity of the input signal and the first acoustic feature quantity of the reference signal, and to calculate the similarity based on the mask pattern, the first acoustic feature quantity, and the second acoustic feature quantity.

3. The sound processing device according to claim 2, wherein the matching processing unit is further configured to calculate a similarity between the first acoustic feature quantity of the input signal and the first acoustic feature quantity of the reference signal, and to calculate the similarity between the input signal and the reference signal based on the mask pattern, the similarity between the first acoustic feature quantities, and the second acoustic feature quantity.

4. The sound processing device according to claim 3, wherein the matching processing unit is configured to calculate the similarity between the first acoustic feature quantities by making a contribution ratio of the reference signal to the similarity between the first acoustic feature quantities larger than a contribution ratio of the input signal to the similarity between the first acoustic feature quantities.

5. The sound processing device according to claim 4, wherein the second acoustic feature quantity is calculated based on a spectrogram of the input signal or the reference signal and has a same granularity in a time axis and a frequency axis as the first acoustic feature quantity.

6. A sound processing method comprising:

calculating, by processing circuitry, a first acoustic feature quantity indicating a likelihood of being a sinusoidal wave of a signal in each time frequency domain and a second acoustic feature quantity different from the first acoustic feature quantity based on an input signal of content to be identified;

calculating, by the processing circuitry, the first acoustic feature quantity and the second acoustic feature quantity based on a reference signal of content prepared in advance; and calculating, by the processing circuitry, a similarity between the input signal and the reference signal based on the first and second acoustic feature quantities of the input signal and the first and second acoustic feature quantities of the reference signal and outputting content attribute data of the content to be identified based on the similarity.

7. A computer-readable device encoded with computer-executable instructions that, when executed by processing circuitry, perform a sound processing method comprising:

calculating a first acoustic feature quantity indicating a likelihood of being a sinusoidal wave of a signal in each time frequency domain and a second acoustic feature quantity different from the first acoustic feature quantity based on an input signal of content to be identified;

calculating the first acoustic feature quantity and the second acoustic feature quantity based on a reference signal of content prepared in advance; and calculating a similarity between the input signal and the reference signal based on the first and second acoustic feature quantities of the input signal and the first and second acoustic feature quantities of the reference signal and outputting content attribute data of the content to be identified based on the similarity.

* * * * *